US008783841B2

(12) United States Patent
Taniuchi

(10) Patent No.: US 8,783,841 B2
(45) Date of Patent: Jul. 22, 2014

(54) IMAGE FORMING METHOD

(75) Inventor: Hiroshi Taniuchi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 603 days.

(21) Appl. No.: 12/765,447

(22) Filed: Apr. 22, 2010

(65) Prior Publication Data

US 2010/0295890 A1 Nov. 25, 2010

(30) Foreign Application Priority Data

May 20, 2009 (JP) ..... 2009-122098

(51) Int. Cl.
*B41J 2/165* (2006.01)

(52) U.S. Cl.
USPC ..... 347/96

(58) Field of Classification Search
None
See application file for complete search history.

(56) References Cited

U.S. PATENT DOCUMENTS

| | | | | |
|---|---|---|---|---|
| 4,398,016 | A | 8/1983 | Homma et al. | |
| 7,419,257 | B2 | 9/2008 | Mouri et al. | |
| 7,494,213 | B2 | 2/2009 | Taniuchi et al. | |
| 2006/0152566 | A1 | 7/2006 | Taniuchi et al. | |
| 2006/0238592 | A1 | 10/2006 | Kadomatsu et al. | |
| 2007/0058019 | A1 * | 3/2007 | Saitoh et al. | 347/101 |
| 2007/0146462 | A1 | 6/2007 | Taniuchi et al. | |
| 2009/0056749 | A1 | 3/2009 | Hori et al. | |
| 2010/0060703 | A1 | 3/2010 | Ohara et al. | |

FOREIGN PATENT DOCUMENTS

| | | | |
|---|---|---|---|
| EP | 0 534 634 | A1 | 3/1993 |
| JP | 05-202328 | A | 8/1993 |

* cited by examiner

*Primary Examiner* — Alejandro Valencia
(74) *Attorney, Agent, or Firm* — Fitzpatrick, Cella, Harper & Scinto

(57) ABSTRACT

The invention provides an image forming method having a step of applying an ink containing a coloring material to a recording medium by an ink jet recording system and a step of applying a reaction liquid which reacts with the ink to the recording medium, in which the ink is brought into contact with the reaction liquid on the recording medium, thereby forming an image, wherein the reaction liquid contains an oil and fat component having an iodine value of 100 or more.

12 Claims, 1 Drawing Sheet

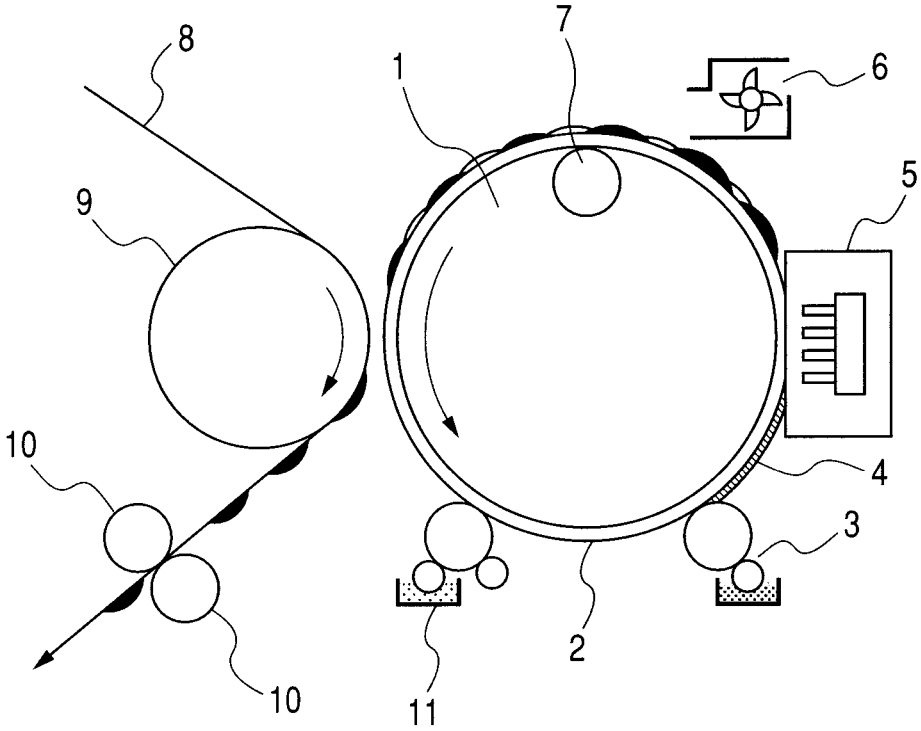
8
7
1
6
5
9
10
4
3
2
10
11

IMAGE FORMING METHOD

BACKGROUND OF THE INVENTION

1. Field of the Invention

The present invention relates to an image forming method using an ink and a reaction liquid which reacts with the ink.

2. Description of the Related Art

An image forming apparatus using an ink jet recording system is widely utilized at present. Since this image forming apparatus is simple in structure of the apparatus itself, even a printer capable of outputting high-definition photographic images is relatively cheaply available. In the ink jet recording system, however, image quality is liable to depend on the ink absorbency of a recording medium. The reason for this is that the fixation of a coloring material in an ink is achieved through permeation and absorption into the recording medium. Thus, it is favorable to use an exclusive recording medium when it is intended to obtain a high-quality image.

On the other hand, a technique of reducing the influence of the ink permeability of a recording medium by using a liquid which reacts with a component in an ink together with the ink to form an image has been proposed. Japanese Patent Application Laid-Open No. H05-202328 has proposed using an ink containing a coloring material having a carboxyl group and a reaction liquid containing a polyvalent metal salt which reacts with the ink to widen the application range of a recording medium.

SUMMARY OF THE INVENTION

The present invention provides an image forming method comprising a step of applying an ink containing a coloring material to a recording medium by an ink jet recording system and a step of applying a reaction liquid which reacts with the ink to the recording medium, in which the ink is brought into contact with the reaction liquid on the recording medium, thereby forming an image, wherein the reaction liquid contains an oil and fat component having an iodine value of 100 or more.

According to the present invention, a novel reaction liquid containing the oil and fat component having an iodine value of 100 or more is used, thereby making it possible to provide an image forming method capable of preparing a printed article of an arbitrary image of high quality, which is excellent in scratch resistance.

Further features of the present invention will become apparent from the following description of exemplary embodiments with reference to the attached drawing.

BRIEF DESCRIPTION OF THE DRAWING

The sole FIGURE conceptually illustrates an image forming apparatus according to the present invention.

DESCRIPTION OF THE EMBODIMENTS

Preferred embodiments of the present invention will now be described in detail in accordance with the accompanying drawings.

Details of the completion of the present invention by the present inventors will be first described. A printed article obtained by such an ink jet recording system using the reaction liquid as described in Japanese Patent Application Laid-Open No. H05-202328 is insufficient in scratch resistance in some cases according to uses.

It is an object of the present invention to provide an image forming method which uses an ink and a reaction liquid and is capable of remarkably improving the scratch resistance of a resulting printed article.

In the conventional ink jet recording using an ink and a reaction liquid, an aggregation reaction caused by these components is generally used. A printed portion obtained thereby is in such a state that solid components in an ink, such as pigment particles, have gathered by this reaction. In this regard, the present inventors have supposed that if these gathered solid components can be made a continuous film, the printed portion is formed of a strong film, and consequently image strength developed in the resulting printed article, including scratch resistance, can be improved.

From the above-described point of view, a further investigation by the present inventors has revealed that when a reaction liquid containing an oil and fat component having an iodine value of 100 or more is used in the formation of an image, the state where solid components in the ink, such as pigment particles, have gathered can be made to be in a filmy form to strengthen the image. The oil and fat component is favorably contained in the form of an emulsion in the reaction liquid. In the present invention, the iodine value is determined by the method prescribed in JIS K 0070.

The present inventors suppose the reason why the strong film is formed by using the reaction liquid containing the oil and fat component having an iodine value of 100 or more to be as follows. First, the above-described aggregation reaction by the ink and the reaction liquid is an ionic reaction, so that a material having no ionicity, such as the oil and fat component having an iodine value of 100 or more, can exist without losing its reactivity even after the ink is mixed with the reaction liquid. On the other hand, the oil and fat component having an iodine value of 100 or more has such a nature that it becomes a macromolecule by reacting with oxygen in the air. Thus, the oil and fat component having an iodine value of 100 or more existing among the solid components in the ink, which have momentarily gathered by the aggregation reaction, exhibits such a function as to crosslink the solid components in the ink as the oxidation reaction of the oil and fat component having an iodine value of 100 or more progresses, so that an image formed by the ink becomes a strong film.

In the image forming method according to the present invention, the reaction liquid containing the oil and fat component having an iodine value of 100 or more and the ink containing a coloring material are applied to a recording medium by a reaction liquid application unit and an ink application unit to bring these components into contact with each other on the recording medium. The order of application of the reaction liquid and the ink may be arbitrary. However, the reaction liquid is favorably applied previously because the effect of the present invention and simplicity in process are easily achieved. In the present invention, a sufficient effect is achieved even by a system in which the ink and the reaction liquid are directly applied to a recording medium to form an image. In addition, when applying a system in which the recording medium is an intermediate transfer medium and an image formed on the intermediate transfer medium is transferred to another recording medium, a higher effect is achieved, and at the same time the effect can be achieved irrespective of the kind of a final recording medium.

Description will hereinafter be given mainly on a mode capable of realizing the present invention more effectively. In other words, the present invention will be described in detail mainly on such a mode that it is a system using an intermediate transfer medium, the application order is such that the reaction liquid is applied prior to the application of the ink, and the ink application unit is of an ink jet recording system. In addition, an exemplary image forming apparatus capable of suitably performing the image forming method according to the present invention is conceptually illustrated in FIGURE. As illustrated in FIGURE, an intermediate transfer medium 1 can be in the form of a roller rotationally driven. A reaction liquid application unit 3 for applying a reaction liquid 4, an ink application unit (ink jet recording head) 5 for ejecting an ink to form an ink image, and a pressure roller 9 for transferring the ink image to a recording medium 8 are provided at regions facing to the periphery, i.e., the surface 2, of the intermediate transfer medium 1.

It is important for the intermediate transfer medium used in the present invention to have such properties that the ink is once received and the ink image formed is then transferred to the recording medium. In particular, the higher the transferability, the better the efficiency of the ink used and the better the cleanability of the surface of the intermediate transfer medium upon repeated use. Accordingly, the surface of the intermediate transfer medium is favorably an ink-non-absorbent surface, more favorably a non-adhesive surface. In addition, it is effective for a surface layer of the intermediate transfer medium to contain a material having elasticity for following the surface of a recording medium (another recording medium than the intermediate transfer medium) such as paper to be brought into sufficient contact with the recording medium.

Examples of a material satisfying these properties include various kinds of plastics and rubbers. In particular, from the viewpoint of non-adhesiveness, silicone rubber, fluorosilicone rubber and fluororubber, which have these properties, are favorable. Among these, silicone rubber is favorably used from the viewpoint of resistance to ink. Since these rubbers may have low surface energies to have poor ink receptivity in some cases, it is better to subject them to a surface treatment.

Examples of the surface treatment include a chemical treatment using chemicals, a physical treatment of changing surface profile and an energy irradiation treatment of irradiating them with ultraviolet light or plasma. The form of the intermediate transfer medium may be any of belt-like and sheet-like forms in addition to the roller-like form illustrated in FIGURE so long as it can be brought into contact with the recording medium. For example, a pad used in pad printing may also be used as the intermediate transfer medium.

No particular limitation is imposed on the reaction liquid application unit, and a general coating mechanism may be applied. Specifically, besides the roll coater illustrated in FIGURE, a spray coater, die coater or wire bar coater may be used. These units may be used in combination.

The reaction liquid is not always required to be applied to the whole surface of the recording medium so long as the solid components in the ink, which have momentarily gathered by the aggregation reaction, can be made to be in a strong film. Thus, the reaction liquid may also be applied while controlling the application amount by using a printing system using, for example, a gravure printing plate, flexographic printing plate or waterless planographic printing plate. In addition, the reaction liquid may also be applied by using an ink jet recording system. In the case where the ink jet recording system is used, the amount of the reaction liquid applied can be controlled depending on ink images. No particular limitation is imposed on the ink jet recording system used, and it may be selected from a thermal system, piezo system and continuous system. When a non-contact application system such as an ink jet recording system or spray coating is used, the selection range of the application order of the reaction liquid can be widened.

As described above, the application of the reaction liquid is favorably conducted prior to the application of the ink. However, the effect of the present invention can also be achieved by applying the reaction liquid after the ink is previously applied to form an ink image. Needless to say, the reaction liquid may be applied both before and after the application of the ink. When the present invention is applied to an image forming apparatus equipped with a multi-pass mode in which an image data is divided to form an image by applying ink plural times, the reaction liquid may also be applied on every application of the ink. The application amount and position may also be controlled every time.

The effect of the present invention may be achieved even by a directly writing system in which the reaction liquid and the ink are applied directly to the recording medium to form an image. However, the above-described system using the intermediate transfer medium is a more ideal system in the present invention. In the case of the directly writing system, the reaction liquid and the ink are applied directly to the recording medium. In this case, the reaction efficiency between the reaction liquid and the ink is affected by the time difference due to the application interval between the reaction liquid and the ink. In other words, when a second liquid applied later is applied to the recording medium before a first liquid applied previously permeates the recording medium, the reaction efficiency becomes higher. On the other hand, in the case of transfer recording, the reaction liquid and the ink are brought into a sufficiently mixed state on the intermediate transfer medium, and the image is then transferred to the recording medium, so that a high reaction efficiency can be achieved irrespective of the application interval between the reaction liquid and the ink.

Components of the reaction liquid used in the present invention will hereinafter be described in detail.

The reaction liquid used in the present invention contains an aggregating component and a film-forming component. The aggregating component is a material that reacts with a coloring material contained in an ink to lower the flowability of the coloring material and is required to be suitably selected according to the kind of the ink used in the formation of an image. It is effective to use, for example, a polymeric flocculant or metal ion as the aggregating component.

Specific examples of the polymeric flocculant as the aggregating component include cationic polymeric flocculants, anionic polymeric flocculants, nonionic polymeric flocculants and ampholytic polymeric flocculants. Examples of the metal ion include divalent metal ions such as $Ca^{2+}$, $Cu^{2+}$, $Ni^{2+}$, $Mg^{2+}$ and $Zn^{2+}$, and trivalent metal ions such as $Fe^{3+}$ and $Al^{3+}$. These ions are favorably applied as respective aqueous solutions of their corresponding metal salts. Examples of anions of the metal salts include $NO_3^-$, $SO_4^{2-}$, $I^-$, $Br^-$, $ClO_3^-$ and $RCOO^-$ (R is an alkyl group). A material having a polarity opposite to that of a coloring material in the ink used may be used as the aggregating component. For example, when the ink is anionic or alkaline, a cationic or acid material having a polarity opposite thereto corresponds to such a material. It is only necessary to control the amount of the aggregating component added to the reaction liquid according to the pigment concentration in the ink used or the application amount thereof. In the case of a general ink jet ink (pigment concentration: about 5% by mass), it will be a standard condition to apply and use a reaction liquid having a metal salt concentration of about 5% by mass or more and 20% by mass or less in an amount of about ½ to 1/10 of the application amount of the ink.

In the present invention, the reaction liquid contains an oil and fat component having an iodine value of 100 or more as the film-forming component. The oil and fat component having an iodine value of 100 or more is an oil and fat component containing unsaturated fatty acids in plenty. Since the oil and fat component is fundamentally not ionized, it can be present in the reaction liquid without being affected by the aggregating component. The content of the unsaturated fatty acids is indicated by the iodine value. Thus, an oil and fat component having a higher iodine value has a nature of more easily bonding to oxygen in the air to have higher curability.

As described above, the iodine value is a value indicating the content of the unsaturated fatty acids in the oil and fat component, and many double bonds are present in the unsaturated fatty acids. These double bonds are slowly broken up with time to cause a reaction with oxygen in the air. The oxygen molecule has two bonds, and an oil and fat molecule is crosslinked to both ends thereof, whereby the oil and fat component finally becomes a macromolecule of a network structure and solidifies. Thus, since crosslinking points increase as the iodine value is higher, the curability becomes higher. On the other hand, when an oil and fat component having a high iodine value is added in a great amount, a coating film with poor flexibility which is easily broken may be formed in some cases. Therefore, the oil and fat component having an iodine value of 100 or more in the reaction liquid is favorably present within the range of the mixing ratio, which will be described later.

Since the double bonds of unsaturated fatty acids become liable to break up by raising the temperature, the curing rate can be increased by heating after printing.

The oil and fat component having an iodine value of 100 or more is favorably an oil and fat component having an iodine value of 130 or more, more favorably an oil and fat component having an iodine value of 170 or more. When the reaction liquid contains such an oil and fat component, the curability becomes high, and the scratch resistance of the resulting image is remarkably improved.

Specific examples of oil and fat components having an iodine value of 130 or more include linseed oil, tung oil, perilla oil, and evening primrose oil. Examples of oil and fat components having an iodine value of from 100 to 130 include sesame oil, rapeseed oil, cotton-seed oil, soybean oil, wheat germ oil and sweet almond oil.

Among these, perilla oil and linseed oil, particularly, perilla oil, is favorably used though it involves a problem of odor.

The form of the oil and fat component having an iodine value of 100 or more contained in the reaction liquid is favorably of an O/W emulsion type (oil-in-water type). As described above, the oil and fat component having an iodine value of 100 or more is easily cured by oxidation. In this type, however, the water film intercepts oxygen, so that stability to curing by oxidation can be retained. On the other hand, in the case of, for example, a system using an intermediate transfer medium, the reaction liquid and an image by the ink are dried on the intermediate transfer medium after application of the reaction liquid, whereby the emulsion form of the oil and fat component having an iodine value of 100 or more can be destroyed to remove the water film. Accordingly, the curing action of the oil and fat component having an iodine value of 100 or more can be efficiently utilized.

The amount of the oil and fat component having an iodine value of 100 or more to be added into the reaction liquid can be adjusted according to the necessary strength of the coating film. Supposing a case where the reaction liquid is used together with a general ink jet ink (solid content: 5% by mass or more to 10% by mass or less) in an amount of the order of, for example, about ½ to 1/10 of the application amount of the ink, the amount of the oil and fat component having an iodine value of 100 or more to be added is favorably within a range of 0.05% by mass or more and 10.00% by mass or less based on the total mass of the reaction liquid. The amount is more favorably 0.10% by mass or more and 5.00% by mass or less.

Besides the aggregating component and the oil and fat component having an iodine value of 100 or more, water, a water-soluble organic solvent and a surfactant may be added in proper amounts to the reaction liquid. The same water-soluble organic solvent(s) as those used in the ink, which will be described later, may be used as the water-soluble organic solvent. The content of water is favorably 50.0% by mass or more and 95.0% by mass or less based on the total mass of the reaction liquid. Likewise, the content of the water-soluble organic solvent is favorably 3.0% by mass or more and 60.0% by mass or less. Likewise, the content of the surfactant is favorably 0.1% by mass or more and 5.0% by mass or less.

Components of the ink used in the present invention will hereinafter be described in detail.

No particular limitation is imposed on the ink used in the present invention. In general, however, a water-based dye ink using a dye as a coloring material or a water-based pigment ink using a pigment as a coloring material is favorably used. In particular, the water-based pigment ink is favorable when a metal salt is used as a reactive material. No particular limitation is imposed on the pigment, and a pigment generally used may be used without any problem. Examples of the pigment include C.I. Pigment Blue: 1, 2, 3, 15, 15:3, 16 and 22; C.I. Pigment Red: 5, 7, 12, 48(Ca), 48(Mn), 57(Ca), 112 and 122; C.I. Pigment Yellow: 1, 2, 3, 13, 16, 74 and 83; Carbon Black No.: 2300, 900, 33, 40 and 52, MA7, MA8, and MCF88 (products of MITSUBISHI CHEMICAL CORPORATION); RAVEN 1255 (product of Columbian Carbon CO.); REGAL: 330R and 660R, and MOGUL (products of CABOT CO.); and Color Black: FW1, FW18, S170 and S150, and Printex 35, (products of Degussa AG).

No particular limitation is imposed on the dye, and a dye generally used may be used without any problem. Examples of the dye include C.I. Direct Blue: 6, 8, 22, 34, 70, 71, 76, 78, 86, 142 and 199; C.I. Acid Blue: 9, 22, 40, 59, 93, 102, 104, 117, 120, 167 and 229; C.I. Direct Red: 1, 4, 17, 28, 83 and 227; C.I. Acid Red: 1, 4, 8, 13, 14, 15, 18, 21, 26, 35, 37, 249, 257 and 289; C.I. Direct Yellow: 12, 24, 26, 86, 98, 132 and 142; C.I. Acid Yellow: 1, 3, 4, 7, 11, 12, 13, 14, 19, 23, 25, 34, 44 and 71; C.I. Food Black: 1 and 2; and C.I. Acid Black: 2, 7, 24, 26, 31, 52, 112 and 118.

No limitation is imposed on the type of the ink used in the present invention, and the ink may be used in such a type as a self dispersion, polymer dispersion or microcapsule type. In the present invention, not only a pigment itself but also a group modifying the pigment or a dispersion polymer being adsorbed on the surface of the pigment or coating the surface of the pigment is regarded as "a coloring material".

In the ink used in the present invention, a resin soluble in water and having a weight-average molecular weight of about 1,000 or more and 15,000 or less is favorably used as the dispersion polymer for dispersing the pigment. Examples of the polymer include block copolymers or random copolymers formed of at least two monomers selected from styrene and derivatives thereof, vinylnaphthalene and derivatives thereof, aliphatic alcohol esters of α,β-ethylenically unsaturated carboxylic acids, acrylic acid and derivatives thereof, maleic acid and derivatives thereof, itaconic acid and derivatives thereof, and fumaric acid and derivatives thereof, and salts of these copolymers.

The content of the organic solvent in the ink is a factor which determines the ejection stability and drying ability of the ink. Since the ink at the time of transfer to a printing medium contains almost only a coloring material and a high-boiling organic solvent, the content of the organic solvent is designed to an optimum value thereof. The organic solvent used is favorably a water-soluble solvent high in boiling point and low in vapor pressure. Examples thereof include polyethylene glycol, polypropylene glycol, ethylene glycol, propylene glycol, butylene glycol, triethylene glycol, thiodiglycol, hexylene glycol, diethylene glycol, ethylene glycol monomethyl ether, diethylene glycol monomethyl ether and glycerol. An alcohol such as ethyl alcohol or isopropyl alcohol may also be added as a component for adjusting a viscosity and a surface tension. In addition, a surfactant and a component for accelerating the oxidative polymerization of the oil and fat component having an iodine value of 100 or more may also be added into the ink.

No particular limitation is imposed on the mixing ratio of the components making up the ink used in the present invention. The mixing ratio may be adjusted according to the ink jet recording system selected or the ejection force of a head or adjusted in an ejectable range from the nozzle diameter etc. In general, the contents of the respective components based on the total mass of the ink are favorably within the following respective ranges. The content of the coloring material is 0.1% by mass or more and 10% by mass or less, the content of the dispersion polymer is 0.1% by mass or more and 10% by mass or less, the content of the organic solvent is 5% by mass or more and 40% by mass or less, the content of the surfactant is 0.1% by mass or more and 5% by mass or less, and the remainder is water such as pure water or ion-exchanged water.

Favorable modes of the steps after the reaction liquid is applied in the present invention will hereinafter be described in detail. First, ink droplets ejected from, for example, such an ink jet recording head 5 as illustrated in FIGURE according to the ink jet recording system come into contact with the reaction liquid applied previously on the intermediate transfer medium, and then the coloring material component reacts with the reaction liquid to lower the flowability. Thus, a high-quality image free of bleeding or beading is formed.

The image formed on the intermediate transfer medium is then transferred to a recording medium. In order to more highly exhibit the effect of the present invention, the image on the intermediate transfer medium is favorably brought into contact with and transferred to the recording medium after most of the water is removed from the image. Water is sufficiently removed, whereby the oil and fat component having an iodine value of 100 or more added can be prevented from permeating the interior of the recording medium together with water and being separated from the coloring material component. At the same time, the image layer with a reduced volume involves small image disorder upon transferring under pressure, so that a good image can be formed on paper with poor absorbency. The ink with an increased viscosity due to removal of water is excellent in transfer efficiency, and so the amount of the ink remaining on the intermediate transfer medium can be reduced. Incidentally, the transferring of the image to the recording medium can be conducted by, for example, bringing the recording surface of the recording medium 8 conveyed by the conveyer rollers 10 into contact with the image formed on the intermediate transfer medium 1 as illustrated in FIGURE and pressurizing the recording medium from the back side thereof by the pressure roller 9.

When water in the image on the intermediate transfer medium before being transferred to the recording medium is positively removed or the process speed is accelerated, it is effective to provide a water-removing step. Examples of a specific unit for accelerating the removal of water include a method in which a heat source is provided to emit heat rays and a method in which water is volatilized from the back side of the intermediate transfer medium 1 using thermal conduction by a heating roller 7 illustrated in FIGURE. There is also a method in which a water-removal-accelerating device 6 of a blower type as illustrated in FIGURE is used to send hot air, thereby accelerating the evaporation of water.

In the image formed on the recording medium in this manner, the added oil and fat component having an iodine value of 100 or more bonds to oxygen in the air with time to form a coating film. When the image is required to improve scratch resistance in a short period of time, the formation of the coating film may be accelerated by exposing the image to hot air or bringing the image into contact with a heating roller. Incidentally, the drying by the hot air in this case is favorably conducted by, for example, treating the image for 10 to 60 seconds at a temperature of 70 to 90° C. With respect to the acceleration of the film formation, it is favorable to use hot air exceeding 100° C. However, there is a possibility that blister (separation) may occur according to the composition of the ink. In the image forming apparatus illustrated in FIGURE, a cleaning unit 11 for cleaning the surface 2 of the intermediate transfer medium 1 is provided because the intermediate transfer medium 1 is used repeatedly plural times after the ink image is transferred to the recording medium 8.

EXAMPLES

The present invention will hereinafter be specifically described by the following Examples and Comparative Examples. Incidentally, all designations of "part" or "parts" and "%" in the following description mean part or parts by mass and % by mass unless expressly noted. The iodine values in Examples are measured by a peroxide value measuring device: MET-809POV (manufactured by SHIBATA SCIENTIFIC TECHNOLOGY LTD.) according to Standard Method for Analysis of Fats, Oils and Related Materials: Acetic Acid-Isooctane Method (prescribed by Japan Oil Chemists' Society).

Example 1

The image forming method according to this example will hereinafter be described for every step. Incidentally, in this example, a system using an intermediate transfer medium is described.

(a) Step of Applying Reaction Liquid to Intermediate Transfer Medium

In this example, an intermediate transfer medium base obtained by coating the surface of a PET film 0.4 mm thick with a silicone rubber (KE12, product of Shin-Etsu Chemical Co., Ltd.) having a rubber hardness of 40° in a thickness of 0.3 mm was used. The surface of this intermediate transfer medium base was further subjected to a surface hydrophilizing treatment using a parallel flat plate type atmospheric pressure plasma treatment apparatus (APT-203, manufactured by Sekisui Chemical Co., Ltd.).

[Surface Modifying Conditions]

Gas used and flow rate: Air, 1,000 cc/min $N_2$, 6,000 cc/min
Voltage applied: 230 V
Frequency: 10 kHz
Treatment speed: 200 mm/min.

As oil and fat components, perilla oil (iodine value: 186), linseed oil (iodine value: 171), tung oil (iodine value: 160), soybean oil (iodine value: 133), sunflower oil (iodine value: 119), corn oil (iodine value: 113), rapeseed oil (iodine value:

105), camellia oil (iodine value: 82) and olive oil (iodine value: 73) were used. Reaction liquids respectively containing these oil and fat components and a reaction liquid containing no oil and fat component were prepared according to the following composition. In the reaction liquid containing no oil and fat component, pure water was contained in place of 0.1 parts of the oil and fat component.

[Composition of Reaction Liquid]

| | |
|---|---|
| $MgNO_3 \cdot 6H_2O$ | 7.0 parts |
| Oil and fat component | 0.1 parts |
| Surfactant (Acetylenol EH, product of Kawaken Fine Chemicals Co., Ltd.) | 1.0 part |
| Diethylene glycol | 20.0 parts |
| Hexylene glycol | 10.0 parts |
| Pure water | 61.9 parts. |

Incidentally, each reaction liquid was provided as an emulsion type by mixing the above-described materials for 35 seconds at 30,000 rpm by means of a homogenizer. Each of the 10 reaction liquids prepared was then applied to the intermediate transfer medium so as to give a coating thickness of 1 μm.

(b) Step of Forming Ink Image on Intermediate Transfer Medium

Inks of four colors were then applied to the intermediate transfer medium to which the reaction liquid had been applied by means of an ink jet recording apparatus (nozzle density: 1,200 dpi, ejection amount: 4.8 pl, drive frequency: 12 kHz) to form character images mirror-reversed. The four color inks used had the following composition. At this time, neither beading nor bleeding was confirmed in all samples at the time when recorded images were formed on the intermediate transfer medium.

[Composition of Ink]

| | |
|---|---|
| Each of the following pigments<br>Black: Carbon black (MCF88, product of MITSUBISHI CHEMICAL CORPORATION)<br>Cyan: Pigment Blue 15<br>Magenta: Pigment Red 7<br>Yellow: Pigment Yellow 74 | 3.0 parts |
| Styrene-acrylic acid-ethyl acrylate copolymer (acid value: 180 mg KOH/g, weight-average molecular weight: 4,000) | 1.0 part |
| Glycerol | 10.0 parts |
| Ethylene glycol | 5.0 parts |
| Surfactant (Acetylenol EH, product of Kawaken Fine Chemicals Co., Ltd.) | 1.0 part |
| Ion-exchanged water | 80.0 parts. |

(c) Step of Transferring Ink Image to Recording Medium

After water in the ink images on the intermediate transfer medium was removed, a recording medium (Aurora Coat, product of Nippon Paper Industries Co., Ltd., basis weight: 73.3 g/m$^2$) was brought into contact with the surface of the intermediate transfer medium by a pressure roller to transfer the images, thereby obtaining each sample.

<Evaluation of Scratch Resistance>

Ten samples of printed articles obtained above were left to stand for 12 hours at ordinary temperature after the printing to evaluate the printed images as to scratch resistance. The test for scratch resistance was conducted by means of an S type friction tester according to the testing method prescribed in 6.2.3 of JIS K 5701-1 (conditions: 300 reciprocations at a load of 400 g). The evaluation of results was determined by the ratio of a retention density after the test to a colored density before the test.

(Evaluation Result)

| Kind of oil and fat component | Iodine value | Colored density retention (%) |
|---|---|---|
| *Perilla* oil | 186 | 81 |
| Linseed oil | 171 | 78 |
| Tung oil | 160 | 70 |
| Soybean oil | 133 | 65 |
| Sunflower oil | 119 | 47 |
| Corn oil | 113 | 42 |
| Rapeseed oil | 105 | 40 |
| *Camellia* oil | 82 | 20 |
| Olive oil | 73 | 17 |
| No oil and fat component contained | | 29 |

All the samples, to which the oil and fat component having an iodine value of 100 or more was added, had very high scratch resistance as demonstrated by the colored density retention of 30% or more. The samples with higher iodine values showed more improved scratch resistance. On the other hand, the samples containing no oil and fat component having an iodine value of 100 or more were insufficient in scratch resistance as demonstrated by the colored density retention less than 30%. The samples to which only the oil and fat component having an iodine value less than 100 was added as the oil and fat component were lower in scratch resistance than the sample containing no oil and fat component.

Example 2

The ten samples obtained in Example 1 were dried for 30 seconds with hot air of 80° C., and the same evaluation of scratch resistance as described above was made after 10 minutes from the printing.

(Evaluation Result)

| Kind of oil and fat component | Iodine value | Colored density retention (%) |
|---|---|---|
| *Perilla* oil | 186 | 79 |
| Linseed oil | 171 | 77 |
| Tung oil | 160 | 73 |
| Soybean oil | 133 | 70 |
| Sunflower oil | 119 | 62 |
| Corn oil | 113 | 57 |
| Rapeseed oil | 105 | 46 |
| *Camellia* oil | 82 | 25 |
| Olive oil | 73 | 27 |
| No oil and fat component contained | | 37 |

All the samples to which the oil and fat component having an iodine value of 100 or more was added had very high scratch resistance as demonstrated by the colored density retention of 30% or more. The samples with higher iodine values showed more improved scratch resistance. On the other hand, the samples containing no oil and fat component having an iodine value of 100 or more were insufficient in scratch resistance as demonstrated by the colored density retention less than 30%. The samples to which only the oil and fat component having an iodine value less than 100 was added as the oil and fat component were lower in scratch resistance than the sample containing no oil and fat component.

Example 3

In this example, a system using no intermediate transfer medium, i.e., a directly writing system, is described. An image was formed on art paper for printing (Tokubishi Art, product of MITSUBISHI PAPER MILLS LIMITED, basis weight: 104.7 g/m$^2$) as a recording medium by means of an ink jet recording apparatus (nozzle density: 1,200 dpi, ejection amount: 4.8 pl, drive frequency: 10 kHz). In this example, a reaction liquid was applied by means of an ink jet recording head and was mounted at a position of a first liquid to be applied prior to the application of an ink in the image forming apparatus to prepare a sample.

The same oil and fat components as those used in Example 1 were used to prepare reaction liquids respectively containing the oil and fat components and a reaction liquid containing no oil and fat component according to the following composition in the same manner as in Example 1. In the reaction liquid containing no oil and fat component, pure water was contained in place of 1.0 parts of the oil and fat component.

[Composition of Reaction Liquid]

| | |
|---|---|
| $CaCl_2 \cdot 2H_2O$ | 10.0 parts |
| Oil and fat component | 1.0 part |
| Surfactant (Acetylenol EH, product of Kawaken Fine Chemicals Co., Ltd.) | 0.5 parts |
| Diethylene glycol | 30.0 parts |
| Pure water | 58.5 parts. |

Incidentally, each reaction liquid was provided as an emulsion type by mixing the above-described materials for 35 seconds at 30,000 rpm by means of a homogenizer.

The inks used had the following composition.

[Composition of Ink]

| | |
|---|---|
| Each of the following pigments<br>Black: Carbon black (MCF88, product of MITSUBISHI CHEMICAL CORPORATION)<br>Cyan: Pigment Blue 15<br>Magenta: Pigment Red 7<br>Yellow: Pigment Yellow 74 | 4.5 parts |
| Styrene-acrylic acid-ethyl acrylate copolymer (acid value: 240 mg KOH/g, weight-average molecular weight: 5,000) | 2.5 parts |
| Glycerol | 10.0 parts |
| Ethylene glycol | 10.0 parts |
| Surfactant (Acetylenol EH, product of Kawaken Fine Chemicals Co., Ltd.) | 1.0 part |
| Ion-exchanged water | 72.0 parts. |

<Evaluation of Scratch Resistance>

Ten samples of printed articles obtained above were left to stand for 12 hours at ordinary temperature after the printing to evaluate the printed images as to scratch resistance. The test for scratch resistance was conducted by means of an S type friction tester according to the testing method prescribed in 6.2.3 of JIS K 5701-1 (conditions: 100 reciprocations at a load of 400 g). The evaluation of results was determined by the ratio of a retention density after the test to a colored density before the test.

(Evaluation Result)

| Kind of oil and fat component | Iodine value | Colored density retention (%) |
|---|---|---|
| *Perilla* oil | 186 | 78 |
| Linseed oil | 171 | 72 |
| Tung oil | 160 | 64 |
| Soybean oil | 133 | 57 |
| Sunflower oil | 119 | 46 |
| Corn oil | 113 | 42 |

-continued

| Kind of oil and fat component | Iodine value | Colored density retention (%) |
|---|---|---|
| Rapeseed oil | 105 | 33 |
| *Camellia* oil | 82 | 24 |
| Olive oil | 73 | 26 |
| No oil and fat component contained | | 27 |

All the samples to which the oil and fat component having an iodine value of 100 or more was added had very high scratch resistance as demonstrated by the colored density retention of 30% or more. The samples with higher iodine values showed more improved scratch resistance. On the other hand, the samples containing no oil and fat component having an iodine value of 100 or more were insufficient in scratch resistance as demonstrated by the colored density retention less than 30%. The samples to which only the oil and fat component having an iodine value less than 100 was added as the oil and fat component were not improved in scratch resistance compared with the sample containing no oil and fat component.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-122098, filed May 20, 2009, which is hereby incorporated by reference herein in its entirety.

What is claimed is:

1. An image forming method comprising:

a step of applying a water-based ink containing a coloring material to a recording medium by an ink jet recording system, wherein a solid content of the ink is 5% by mass or more and 10% by mass or less; and a step of applying a reaction liquid to the recording medium on which the ink is applied, the reaction liquid reacting with the ink, wherein the ink is brought into contact with the reaction liquid on the recording medium, thereby forming an image, and wherein the reaction liquid contains water and an oil and fat component having an iodine value of 100 or more, wherein an amount of the oil and fat component is 0.05% by mass or more and 10.00% by mass or less based on the total mass of the reaction liquid, and wherein the ratio of an application amount of the reaction liquid to an application amount of the ink is from ½ to 1/10.

2. The image forming method according to claim 1, wherein the oil and fat component is contained in a form of an emulsion.

3. The image forming method according to claim 1, wherein the reaction liquid contains an aggregating component which aggregates the coloring material.

4. The image forming method according to claim 1, wherein the coloring material is a pigment.

5. The image forming method according to claim 1, wherein the recording medium is an intermediate transfer medium, and an image formed on the intermediate transfer medium is transferred to a second recording medium other than the intermediate transfer medium.

6. An image forming apparatus comprising:

an ink application unit for applying a water-based ink containing a coloring material to a recording medium by an ink jet recording system, wherein a solid content of the ink is 5% by mass or more and 10% by mass or less; and a reaction liquid application unit for applying a reaction liquid to the recording medium on which the ink is applied, the reaction liquid reacting with the ink, wherein the ink is brought into contact with the reaction liquid on the recording medium, thereby forming an image, and wherein the reaction liquid contains water and an oil and fat component having an iodine value of 100 or more, wherein an amount of the oil and fat component is 0.05% by mass or more and 10.00% by mass or less based on the total mass of the reaction liquid, and wherein the ratio of an application amount of the reaction liquid to an application amount of the ink is from ½ to 1/10.

7. The image forming apparatus according to claim 6, wherein the oil and fat component is contained in a form of an emulsion.

8. The image forming apparatus according to claim 6, wherein the reaction liquid contains an aggregating component which aggregates the coloring material.

9. The image forming apparatus according to claim 6, wherein the coloring material is a pigment.

10. The image forming apparatus according to claim 6, wherein the recording medium is an intermediate transfer medium, and an image formed on the intermediate transfer medium is transferred to a second recording medium other than the intermediate transfer medium.

11. The image forming apparatus according to claim 6, wherein the oil and fat component is at least one of linseed oil, tung oil, perilla oil, evening primrose oil, sesame oil, rapeseed oil, cotton-seed oil, soybean oil, wheat germ oil and sweet almond oil.

12. The image forming method according to claim 1, wherein the oil and fat component is at least one of linseed oil, tung oil, perilla oil, evening primrose oil, sesame oil, rapeseed oil, cotton-seed oil, soybean oil, wheat germ oil and sweet almond oil.

* * * * *